US009572469B2

(12) United States Patent
Goff

(10) Patent No.: US 9,572,469 B2
(45) Date of Patent: Feb. 21, 2017

(54) CYLINDRICAL BRUSH ASSEMBLY FOR A FLOOR MAINTENANCE MACHINE

(71) Applicant: Sean K. Goff, Bristol, WI (US)

(72) Inventor: Sean K. Goff, Bristol, WI (US)

(73) Assignee: RPS Corporation, Racine, WI (US)

( * ) Notice: Subject to any disclaimer, the term of this patent is extended or adjusted under 35 U.S.C. 154(b) by 95 days.

(21) Appl. No.: 14/612,914

(22) Filed: Feb. 3, 2015

(65) Prior Publication Data

US 2016/0220086 A1 Aug. 4, 2016

(51) Int. Cl.

| | |
|---|---|
| ***A47L 11/40*** | (2006.01) |
| ***A47L 11/282*** | (2006.01) |
| ***A46B 7/04*** | (2006.01) |
| ***A46B 7/10*** | (2006.01) |
| ***A46B 13/00*** | (2006.01) |
| *A46B 9/02* | (2006.01) |

(52) U.S. Cl.

CPC ..... *A47L 11/4041* (2013.01); *A46B 7/044* (2013.01); *A46B 7/10* (2013.01); *A46B 13/001* (2013.01); *A46B 13/006* (2013.01); *A47L 11/282* (2013.01); *A46B 9/026* (2013.01); *A46B 2200/3066* (2013.01)

(58) Field of Classification Search

CPC ..... A47L 11/22; A47L 11/32; A47L 11/4041; A46B 9/026; A46B 13/001

See application file for complete search history.

(56) References Cited

U.S. PATENT DOCUMENTS

| | | | | |
|---|---|---|---|---|
| 2,319,451 | A | 5/1943 | Groene et al. | |
| 2,330,584 | A | 9/1943 | Hoagland | |
| 2,415,300 | A | 2/1947 | Lovely | |
| 2,848,401 | A | 8/1958 | Hartley | |
| 3,181,193 | A | 5/1965 | Nobles et al. | |
| 3,380,098 | A | 4/1968 | Nelson | |
| 4,018,014 | A | 4/1977 | Belanger | |
| 5,400,461 | A | 3/1995 | Malish et al. | |
| D394,530 | S | 5/1998 | Roeker | |
| 5,819,400 | A | 10/1998 | Sargeant | |
| D408,601 | S | 4/1999 | Winter et al. | |
| D441,927 | S | 5/2001 | Creecy | |
| 6,324,714 | B1 * | 12/2001 | Walz | A46B 13/001 15/392 |
| 6,427,373 | B1 | 8/2002 | Schuemann | |
| 7,347,771 | B2 | 3/2008 | Wentworth et al. | |
| 8,826,493 | B2 * | 9/2014 | Stegens | A46B 13/001 15/23 |
| D718,103 | S | 11/2014 | Geissele | |
| 9,212,860 | B2 | 12/2015 | Kunau | |
| 2012/0131835 | A1 | 5/2012 | Barrett et al. | |
| 2012/0216439 | A1 | 8/2012 | Barrett et al. | |
| 2015/0007478 | A1 | 1/2015 | Barrett et al. | |
| 2015/0266168 | A1 | 9/2015 | Geissele | |

(Continued)

OTHER PUBLICATIONS

Factorycat Tomcat, Product Change Bulletin P-600A, MiniMag, Magnum, GTX, XR—With Cylindrical Decks, Nov. 18, 2011, 2 pages.

(Continued)

*Primary Examiner* — Shay Karls

(74) *Attorney, Agent, or Firm* — Quarles & Brady LLP

(57) ABSTRACT

A cylindrical brush with an improved core and a mating driving hub have axially inclined splines that engage one another to form an improved cylindrical brush assembly for a floor maintenance machine.

23 Claims, 8 Drawing Sheets

(56) References Cited

U.S. PATENT DOCUMENTS

2016/0010938 A1 1/2016 Merkley et al.

OTHER PUBLICATIONS

Helical Gears posted by REMPCO, available Oct. 9, 2014, © 2016 Rempco Inc., [online], [site visited Dec. 9, 2016]. Available from Internet, <URL: http://web.archive.org/web/20141009023045/http:/rempco.com/gears/helical/>.

Spiral Broaching & Helical Broaching posted by VW Broaching Service, Inc., available Oct. 31, 2014, © 2015-2016 VW Broaching Service, Inc, [online], [site visited Dec. 9, 2016]. Available from Internet, <URL: http://web.archive.org/web/20141 031234530/http://www.vwbroaching.com/spiral-broaching. html>.

Internal Splining Capabilities posted by Industrial Jig & Fixture., available Oct. 30, 2014, © 2014 Industrial Jig & Fixture, Inc, [online], [site visited Dec. 9, 2016]. Available from Internet, <URL: http://web.archive.org/web/20141030105455/http://industrialjigandfixture.com/internal-splines-keyways/index.html>.

Broaching Machine posted by Tex Computer, posting date not given, [online], [site visited Dec. 9, 2016]. Available from Internet, <URL: https://www.texcomputer.com/en/content/broaching-machine>.

* cited by examiner

CYLINDRICAL BRUSH ASSEMBLY FOR A FLOOR MAINTENANCE MACHINE

CROSS-REFERENCE TO RELATED APPLICATION

Not applicable.

STATEMENT OF FEDERALLY SPONSORED RESEARCH OR DEVELOPMENT

Not applicable.

BACKGROUND

This invention relates to equipment for floor maintenance machines and, in particular, to cylindrical brush assemblies for floor maintenance machines.

Floor maintenance machines or scrubbers provide an industrial strength way to clean dirty floor surfaces. Typically, an operator directs a floor maintenance machine over the surface to be cleaned by steering or guiding the floor maintenance machine. The large rotating brushes of the floor maintenance machine directly contact the floor surface that, with the help of supplied cleaning liquid, loosen debris that is on the surface of the floor. Often, this debris is lifted from the floor and is then contained in a collection chamber on the floor maintenance machine.

The rotary brushes of these floor maintenance machines may take different forms. In some forms, the rotary brushes are axial face brushes in which the bristles are all generally parallel with the axis of brush rotation and the ends of the bristles are directed downward to contact the floor. In other forms, the rotary brushes are horizontal cylindrical brushes which rotate about an axis of rotation that is generally parallel with the surface to be cleaned. These brushes each provide a different type of cleaning action. Floor maintenance machines may incorporate one or both of these types of brushes as well as potentially other types of cleaning or scrubbing implements.

These brushes are consumable and have a limited useful life. In some instances, the brush must be discarded due to wear of the bristles and must be replaced. However, another mode of brush failure may be at the point of power transmission to the brush between the driving hub and an insert or core of the brush. For example, over time, the core of the brush or the mechanical structure supporting the bristles may become mechanically weakened by virtue of being exposed to constant and cyclic rotary forces when the brushes are driven at 750 to 1000 rotations per minute (typically). Under these stress conditions and with some side-to-side dimensional play existing between the brush and driving hub in the lateral direction, it is possible that the brush insert or core can become pre-maturely damaged, requiring replacement of the entire brush, regardless of whether or not the bristled brush section has been fully worn. As the bristled brush section is typically far more expensive than the insert or core of the brush, it is unfortunate when an entire brush (that is, the bristled brush section and core together) must be replaced as a result of the failure of solely the insert or core because most of the value of the brush is lost.

In extreme circumstances, it is even possible that the driving hub by which the brush is driven might become damaged or fatigued. Because the driving hub is not readily viewable by the user, even during replacement of a brush, any damage to the driving hub may go unnoticed if it occurs.

If the driving hub becomes damaged, this can have a compounding effect and result in the further damage of the new inserts or cores of good brushes which continue to be driven by the now-damaged driving hub. If this happens, it is possible that the end user will not appreciate that the hub is damaged, but rather assume that there is something faulty with the otherwise acceptable brushes that are being supplied. Accordingly, such damage to the hub/brush interface can result in expensive repairs and unnecessary replacement of brushes.

SUMMARY OF THE INVENTION

In the case of horizontally-oriented cylindrical brushes, the brushes have conventionally been driven through connection of a driving hub that transmits the rotary motion of the hub to the cylindrical brush. Usually, axially-extending splines that are parallel with the shared axis of rotation of the brush and driving hub engage one another to drive the brush. For the sake of illustration, a prior art driving hub 144 is illustrated in FIG. 6. In the prior art driving hub 144, the hub includes a generally cylindrically shaped body 148 with a flange 153 on one end thereof in which the body 148 is centered about the axis of rotation of the hub 144. The body has a plurality of axially-extending splines 160 (typically, six splines) that extend from the flanged end toward the other end onto which the cylindrical brush will be received over the body 148 in such a way that the centerline of these splines 160 are parallel to the axis of rotation of the driving hub 144. To accommodate reception of the cylindrical brush onto the hub 144, these splines 160 may narrow to a tip on the non-flanged end and have a narrowing taper or draft from the flanged end to the non-flanged end of the splines 160.

However, the engagement of purely-axially extending splines with a minimal amount of symmetrical taper along their centerline towards their respective tips permits the cylindrical brush to have some amount of horizontal float or slop along the axis of rotation. This means (1) that the splines may not consistently engage one another as the core of the brush might shift at least minimally back and forth laterally along the driving hub, (2) that audible rattling noises may result as the brush moves back and forth on the hub along the horizontal rotational axis, (3) that uneven wear may occur over the length of the splined connection, and (4) that spaces or gaps may develop between the axial ends of the cylindrical brush and the driving hub or an opposing idler hub (and intermediate gaskets) and these spaces or gaps may permit the ingress of debris and chemicals into the splined interface between the components where it can be abrasive. The ingress of debris can potentially result in a loading profile across the splines that is inconsistent with the loading profile that was original engineered into the design. As noted above, the ingress of debris can potentially damage the insert of the brush and/or the driving hub and, in the case of damage to the driving hub, result in premature failure of a new brush, even when there is nothing wrong with the new brush.

Disclosed herein are improvements for cylindrical brush assemblies in which the cylindrical brush is reliably retained on a driving hub through the use of axially-inclined splines. When the driving hub drives the rotation of the cylindrical brush, the torque applied to the axially-inclined splines cause the brush to be axially pulled onto the hub such that the brush may be consistently positioned along the axis of rotation and may engage an intermediate gasket to prevent the ingress of debris and chemicals into the brush/hub interface.

According to one aspect of the invention, a cylindrical brush assembly is disclosed for a floor maintenance machine. The cylindrical brush assembly includes a cylindrical brush and a driving hub. The driving hub has a radially outward facing surface with a plurality of axially-inclined splines that are oblique to an axis of rotation of the driving hub. The cylindrical brush has a core with a radially inward facing surface with a plurality of axially-inclined splines that correspond to the plurality of axially-inclined splines on the driving hub. The cylindrical brush is received on one axial end of the driving hub such that the plurality of axially-inclined splines of the driving hub engage the plurality of axially-inclined splines of the core of the cylindrical brush.

In some forms, the driving hub may be received on one axial end of the cylindrical brush and the cylindrical brush assembly may further comprise an idler hub that is received on the other axial end of the core of the cylindrical brush. This idler hub may share the axis of rotation of the cylindrical brush and the driving hub. The idler hub may have a shape and profile nearly identical or identical to the driving hub, and so the idler hub can have a radially outward facing surface with a plurality of axially-inclined splines that are also oblique to the axis of rotation. This allows for the brush to be rotated and flipped, for better wear. Given that the splines the angular inclination will pull the driving hub into the insert on the driving hub side, on the idler side the insert may be slightly separated from the idler hub (that is, on the opposing side of the core from the driving hub, the brush may be pulled away from the idler although remain engaged therewith). A small gap on the idler side is acceptable, since that engagement at the idler and insert is not transferring the torque load to turn the brush and historically it has been observed that it is nearly always the driver side of the brush that wears out prematurely.

The driving hub may have an insertion end on one axial end of the driving hub that is received into the core of the cylindrical brush and a flanged end on the other axial end of the driving hub. When the driving hub is rotated about the axis of rotation in one of the two possible rotation directions, the engagement of the plurality of axially-inclined splines of the driving hub with the plurality of axially-inclined splines of the core of the cylindrical brush can cause the cylindrical brush to be both rotationally driven about the axis of rotation and to be axially driven toward the flanged end of the driving hub (given the splines are oblique to the axis of rotation). Typically, an intermediate and compressible gasket may located between the flanged end of the driving hub and the brush so as to form a consistent seal therebetween under the application of torque.

To better facilitate the insertion of the hub into the core during assembly, a width or angular extent of the plurality of axially-inclined splines on the driving hub may narrow at the insertion end. In this way, the driving hub does not need to be precisely oriented with respect to the core initially during assembly or insertion of the brush assembly into the floor maintenance machine.

In order to accommodate the reception of a driving shaft for driving the rotation of the driving hub, the driving hub may further include an opening that extends axially through the driving hub for reception of the driving shaft. This opening may be keyed to facilitate a transfer of power from the driving shaft to the driving hub.

In some forms, the cylindrical brush may further include a shell surrounding the core and, on this shell, a plurality of radially extending bristles may be supported. Typically, the core may be press fit into the shell to irreversibly mechanically join these two components to one another. However, in other forms, it is contemplated that the bristles may be directly supported by the core without there being an intermediate element such as a shell or that there may be additional intermediate elements between the core and the shell.

At least some of the splines on the core and driving hub may have an undercut on their angular faces. These undercuts on the core and the driving hub may then engage one another when the hub is inserted into the core such that they grip into one another during rotation.

As the splines are not screw threads per se, it is contemplated that the plurality of axially-inclined splines on the driving hub and the cylindrical brush may extend less than 45 or 90 degrees angularly, for example, around the axis of rotation from one axial end of the splines to the other. In this way, there is angular engagement of the splines, but not threaded engagement.

According to another aspect of the invention, a floor maintenance machine includes the cylindrical brush assembly according to any of the forms described herein.

According to still another aspect of the invention, a cylindrical brush is disclosed for use in a cylindrical brush assembly of a floor maintenance machine. The cylindrical brush includes a core extending along an axis of rotation of the cylindrical brush and having an opening centrally disposed along the axis of rotation. This opening has a radially inward facing surface supporting a plurality of axially-inclined splines. The core also supports a plurality of radially outward extending bristles.

The cylindrical brush may further include a shell that surrounds a radially outward facing surface of the core and the plurality of radially extending bristles may be supported by the shell. As noted above, it is contemplated that the core may be press fit into the shell.

Further, in some forms, the angular face of at least some of the plurality of splines on the core may include an undercut adapted for engagement with a corresponding undercut on a driving hub.

As noted above, the plurality of axially-inclined splines may extend less than 45 or 90 degrees angularly around the axis of rotation from one axial end of the opening of the core to the other axial end of the opening of the core.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1A:
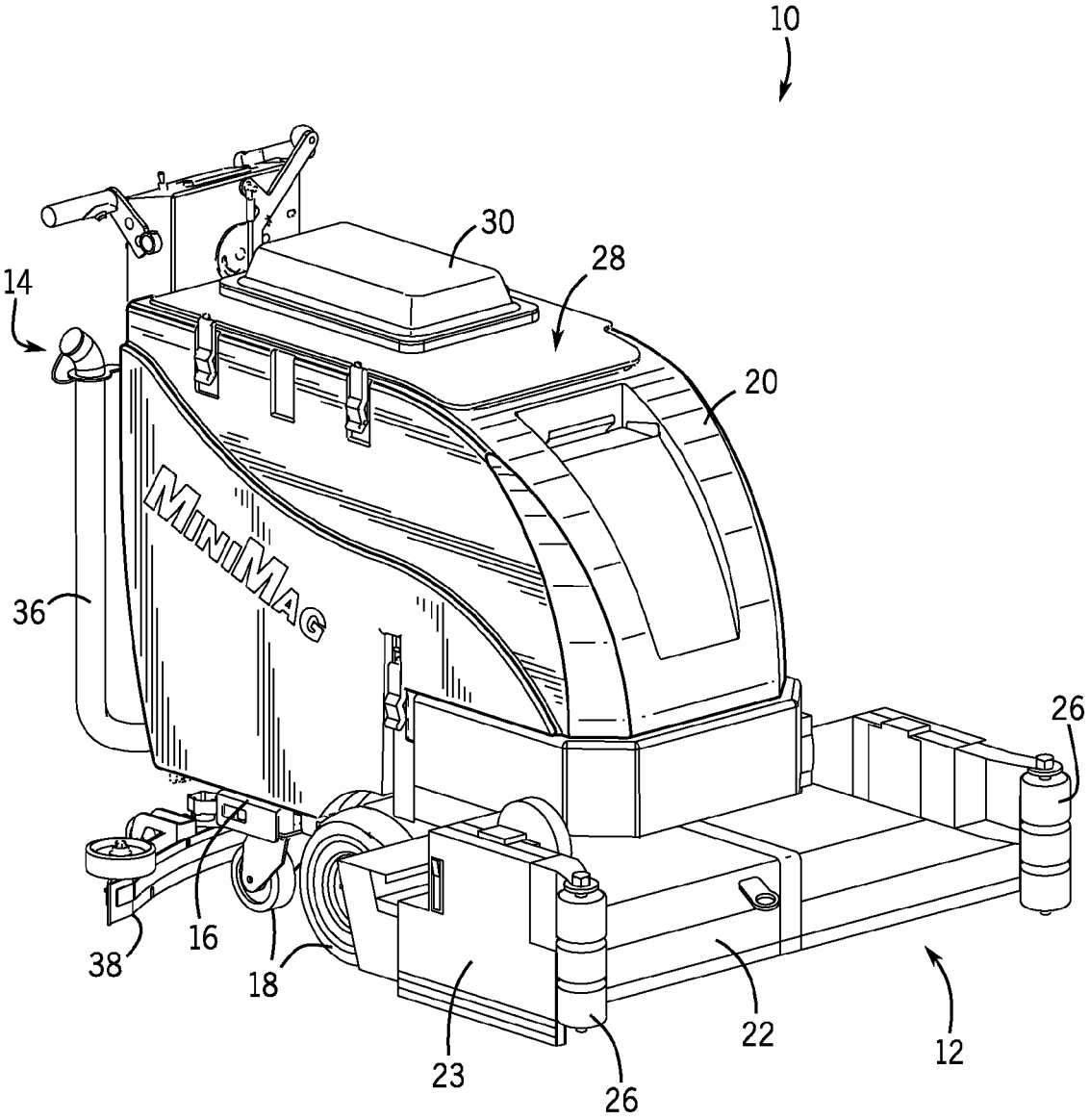
FIG. 1A is a perspective view of a walk-behind floor maintenance machine.
Figure 1B:
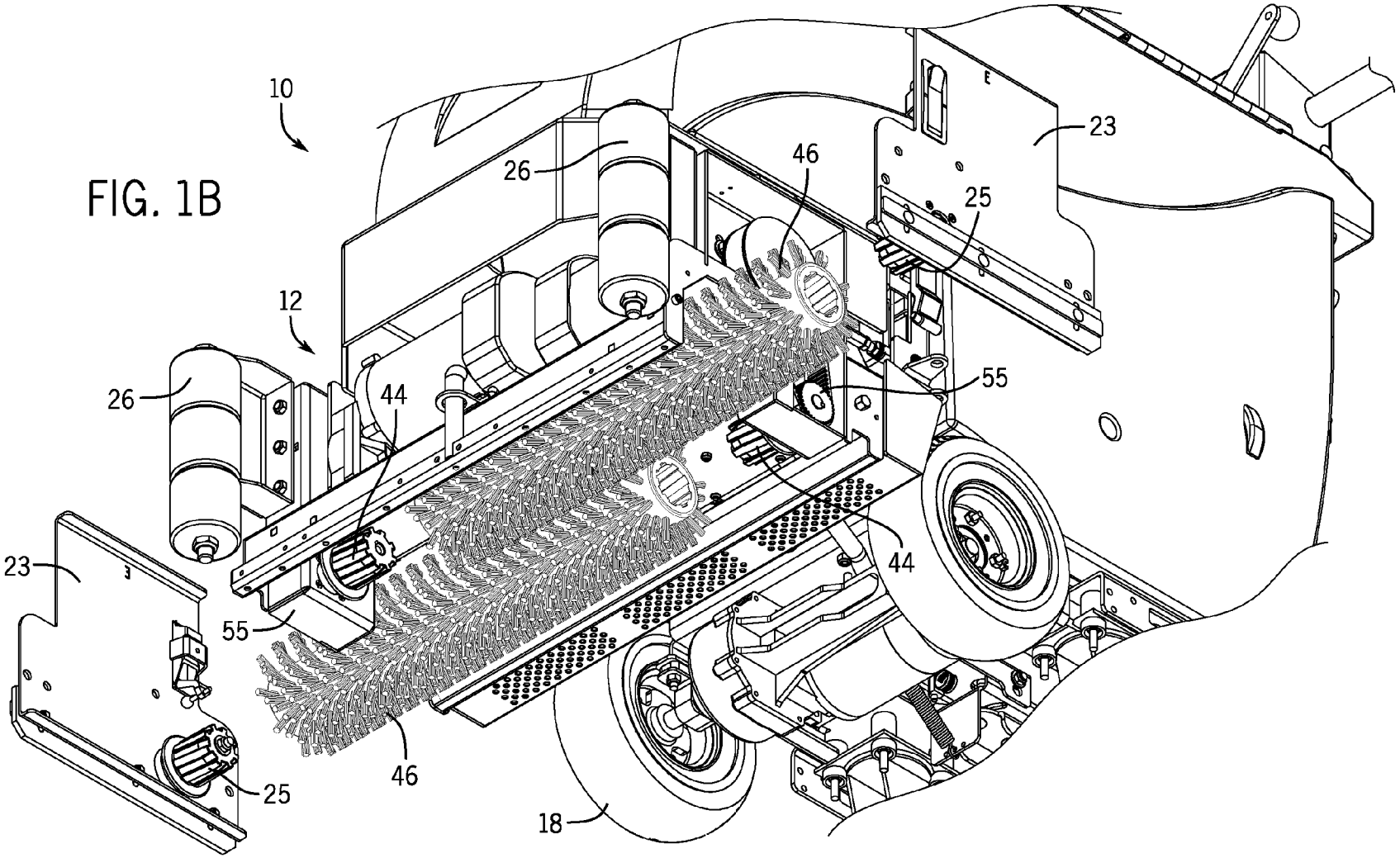
FIG. 1B is a partially exploded perspective view of the underside of the floor maintenance machine in the region of the driving and idler hubs and the cylindrical brush.

Referring first to FIGS. 1A and 1B, an exemplary floor maintenance machine 10 is shown for the cleaning of floors. The floor maintenance machine 10 is a walk-behind floor scrubber, such as the MiniMag scrubber manufactured by R.P.S. Corporation of Racine, Wis. However, the floor scrubber 10 could be any kind of floor scrubber 10 including both walk-behind or riding-type floor scrubbers. Some other non-limiting examples of floor maintenance machines that may incorporate the brush assembly described herein include the Magnum scrubber, the Pilot micro-scrubber, the GTX rider scrubber, and the XR rider scrubber, all of which are manufactured by R.P.S. Corporation of Racine, Wis.

In the form shown, the floor maintenance machine 10 has a front end 12 and a rear end 14 behind which an operator may stand. A chassis 16 extends between the front end 12 and the rear end 14. The chassis 16 has a set of wheels 18 mounted on the bottom side thereof for contact with the floor. The body of the chassis 16 is largely covered by a liftable hood 20. The liftable hood 20 covers a number of the internal components of the floor maintenance machine 10 (such as, for example, the battery).

At the front end 12 of the floor maintenance machine 10 and near the bottom of the liftable hood 20, a brush housing 22 partially surrounds a brush assembly (which is illustrated in greater detail in subsequent figures) for scrubbing the floor surface. In the illustrated embodiment, the brushes in the brush assembly are horizontally-oriented cylindrical brushes. As is best illustrated in the partially exploded view of the underside of the floor maintenance machine 10 in FIG. 1B (in which the sidewalls 23 supporting the idler hubs 25 are exploded from the main body), the bottom of the brush housing 22 is open, such that the bristles of the cylindrical brushes of the brush assemblies 42 can come into contact with the surface of the floor for cleaning. The brush housing 22 supports a set of bumpers 26 that prevent damage in the event that the floor maintenance machine 10 bumps into a stationary object.

The liftable hood 20 has a reservoir 28 formed therein. A removable cover 30 is placed over the reservoir 28 and, when lifted, provides access to the reservoir 28. The reservoir 28 serves as a tank for holding the cleaning fluid, such as water or a soapy fluid. The reservoir 28 can also serve as a recovery tank that is used to hold the cleaning fluid after it has been used and recovered using a vacuum system or the like.

Although the reservoir 28 is shown as being formed in part of the liftable hood 20. The reservoir 28 could be separately formed and/or placed in an alternate location on the floor maintenance machine 10.

Although it cannot be seen in FIG. 1A, the reservoir 28 includes a fluid passageway that extends to an outlet. The outlet is placed proximate the brushes of the brush assembly or assemblies such that the outlet can dispense cleaning fluid from the reservoir 28 to the floor or brushes during operation of the floor maintenance machine 10.

The floor maintenance machine 10 additionally includes a number of other optional parts. A drain hose 36 is connected to the side of the floor maintenance machine 10 and can be lowered to drain the reservoir 28. A squeegee 38 extends across the rear end 14 of the floor maintenance machine 10 to contain and direct any cleaning fluid applied to the floor. In some forms of the floor maintenance machine 10, a vacuum system may be mounted to or proximate to the squeegee 38 to collect excess fluid.

Figure 2:
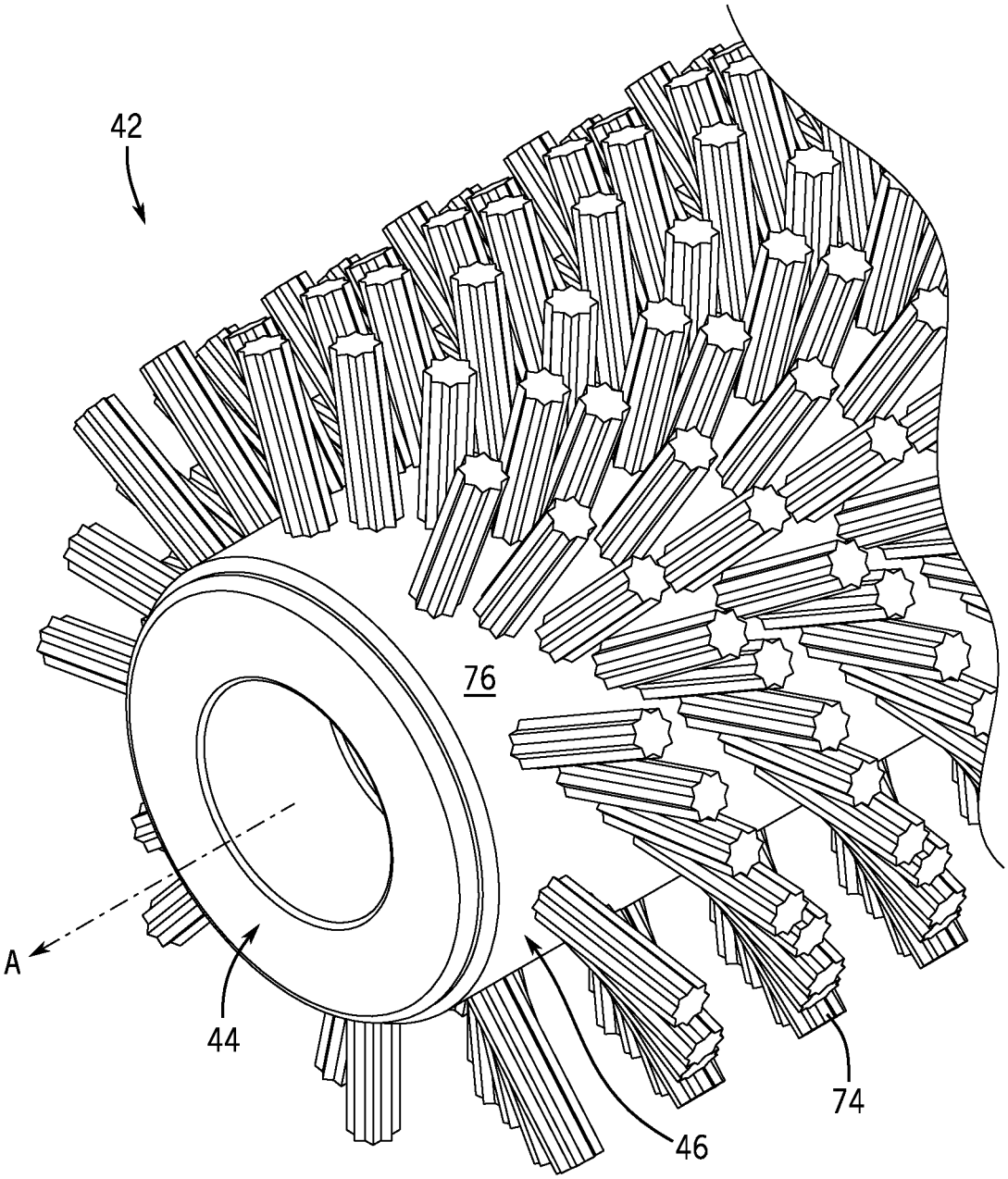
FIG. 2 is a perspective view of one axial end of a cylindrical brush assembly for use in a walk-behind floor maintenance machine of FIGS. 1A and 1B in which the cylindrical brush assembly includes a cylindrical brush with a driving hub inserted into it.
Figure 3B:
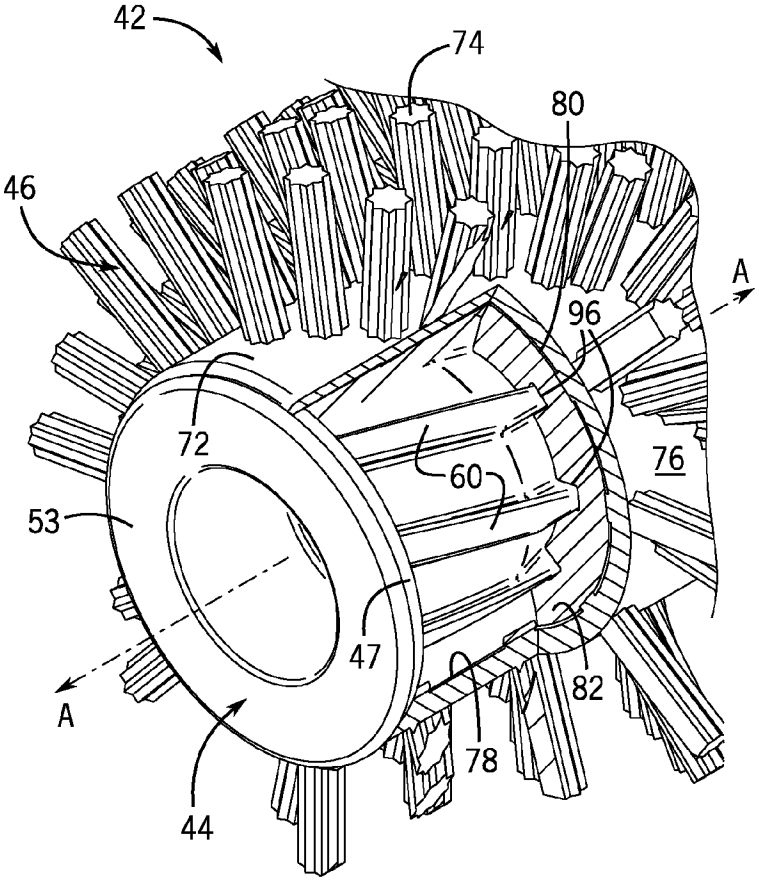
FIGS. 3A and 3B are perspective views of the sequential insertion steps of the driving hub into a core of the cylindrical brush in which the wall of the brush is partially broken away to reveal the splined engagement of the components.
Figure 3A:
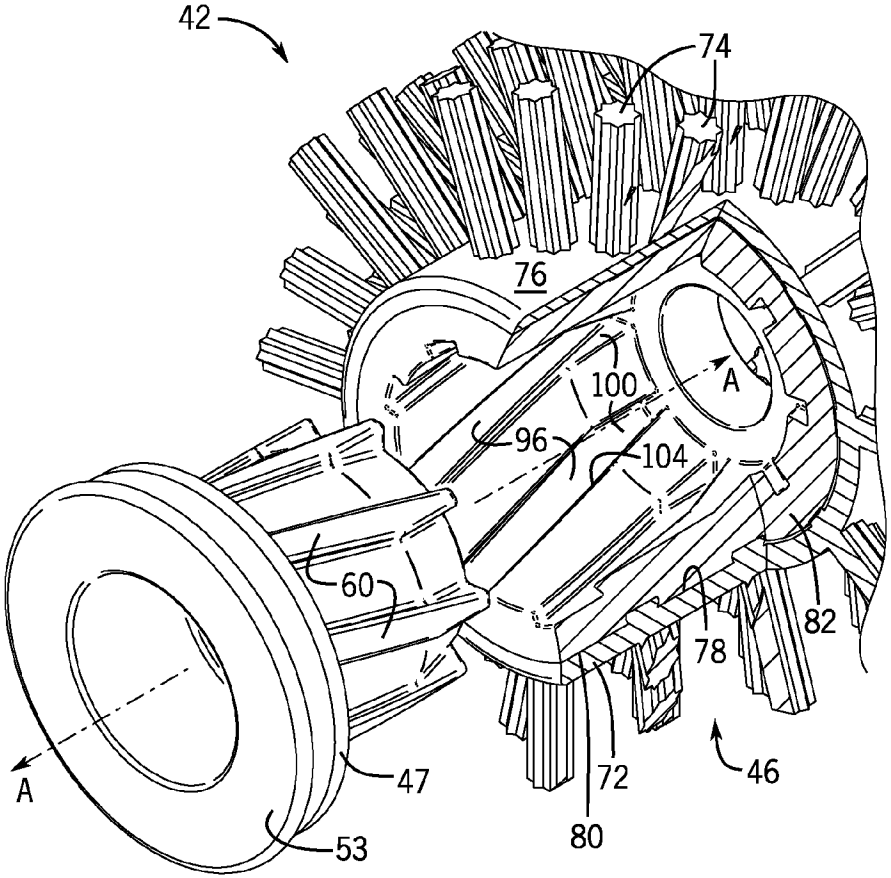
Figure 4A:
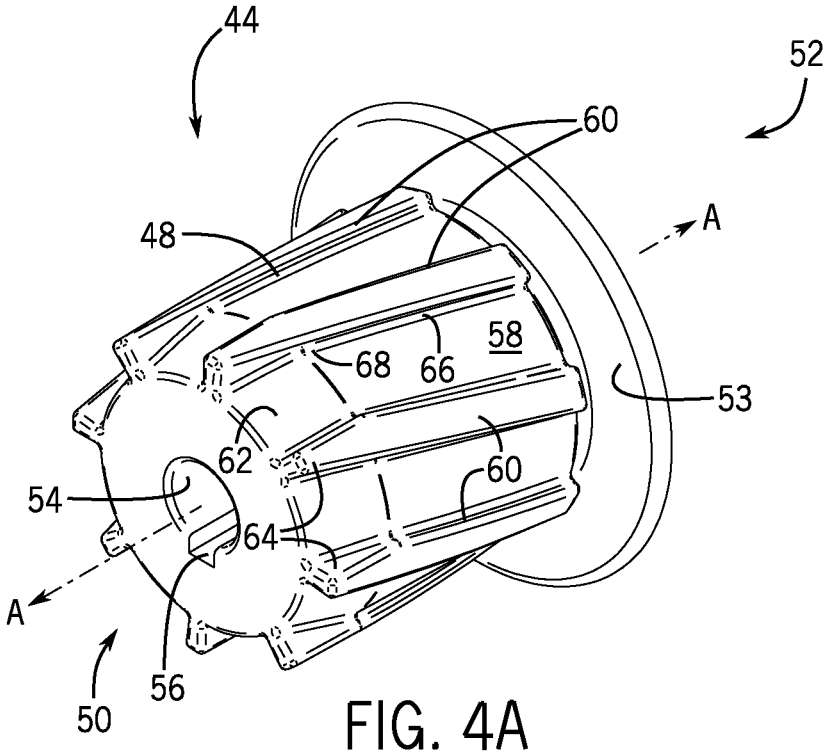
FIGS. 4A through 4E are various detailed views of the driving hub respectively including a perspective view of the axial insertion end of the hub, a perspective view of the flanged end of the hub, a plan view of the axial insertion end, an elevational side view, and a cross-sectional side view.
Figure 4B:
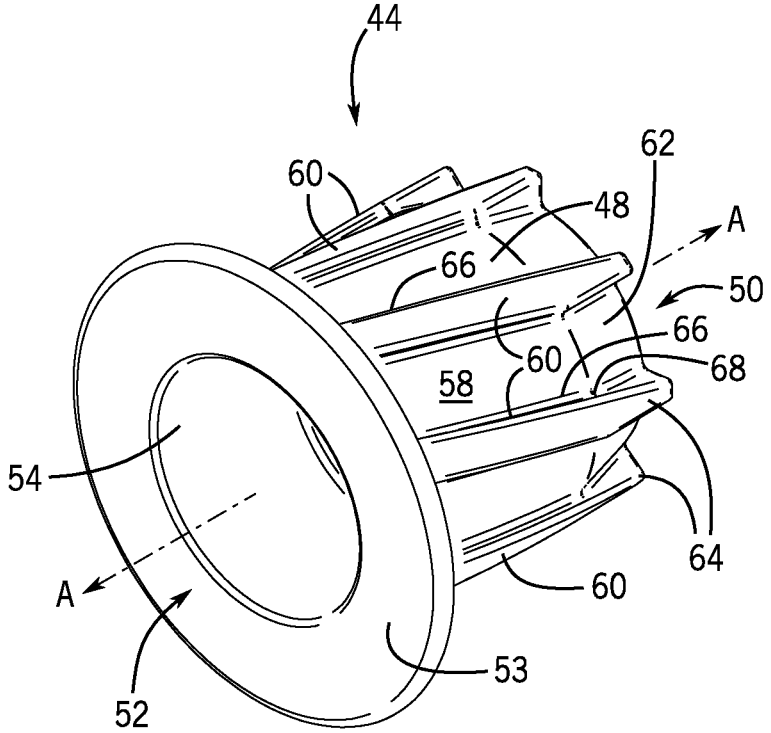
Figure 4C:
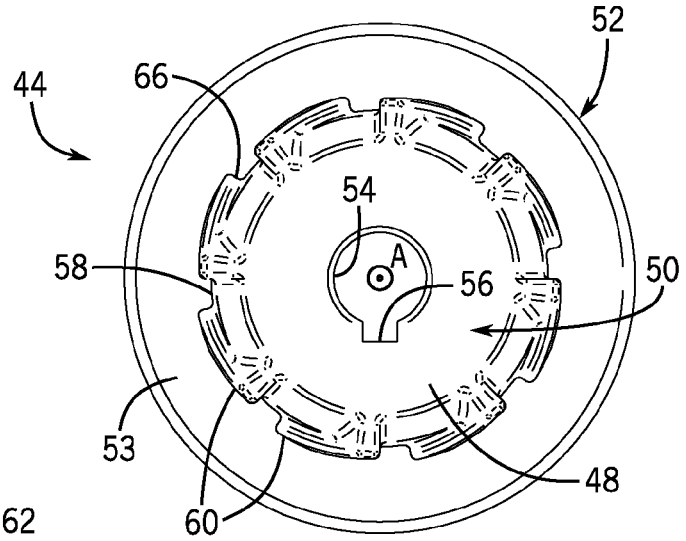
Figure 4D:
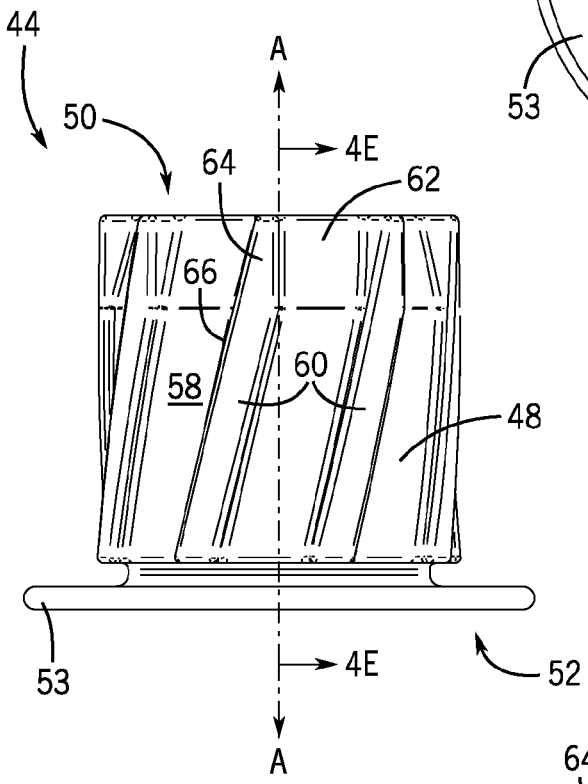
Figure 4E:
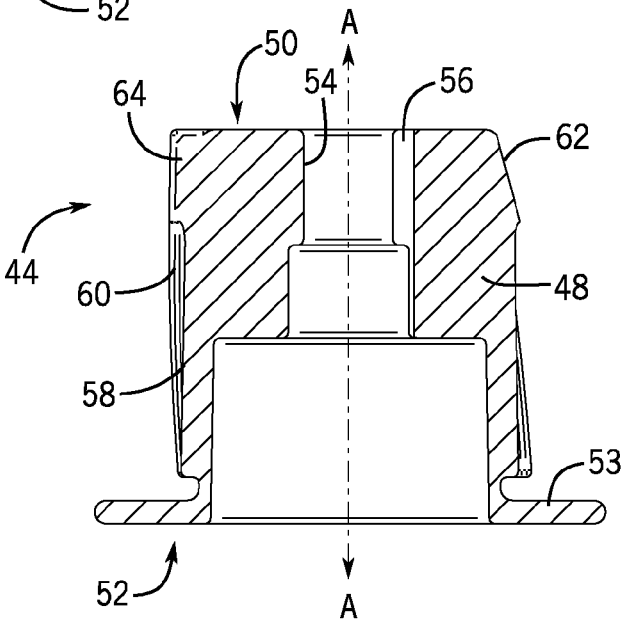

Turning now to FIGS. 2, 3A and 3B and with reference to FIG. 1B, a cylindrical brush assembly 42 is illustrated that could be employed in a floor maintenance machine 10 of the type illustrated in FIGS. 1A and 1B or in other types of floor maintenance machines. As used herein, the term "brush" is intended to include what in the industry are commonly known as brushes (for example, densely-packed bristles used for wet scrubbing application) as well as brooms or sweepers (for example, less-densely packed bristles which can facilitate the picking up of larger debris such as soda cans often in dry sweeping applications). The cylindrical brush assembly 42 includes three primary components: a driving hub 44 and a cylindrical brush 46, and an intermediate gasket 47. FIG. 1B illustrates, at a macro level, how the assembly of the cylindrical brush 46 into the floor maintenance machine occurs. In short, the side walls 23 supporting the idler hubs are removed and one end of each of the cylindrical brushes 46 are inserted into the driving hubs 46. Upon reassembly of the side walls 23 onto the machine, the idler hubs 25 are inserted into the opposing ends of each of the cylindrical brushes 46. It will be appreciated that the idler hubs 25 may have a shape resembling the driving hub 44 and be received in the other axial end of the cylindrical brush 46, but may be made of a different material and travel under the applied rotation of the brush (and are not driven by an independent driving shaft as the driving hubs 44 are).

Now, with additional reference being made to FIGS. 4A through 4E, the driving hub 46 is illustrated in greater detail. The driving hub 46 may be fabricated from a brass material and includes a generally cylindrically shaped body 48 that extends along an axis of rotation A-A from an insertion end 50 at one axial end to a flanged end 52 at the other axial end. On the flanged end 52, a flange 53 radially extends away from the body 48. In the particular form illustrated, the body 48 also includes an opening 54 extending along the axis of rotation A-A that is adapted for reception of a driving shaft (not explicitly shown, but in the drive chain 55 in FIG. 1B) of the floor maintenance machine 10 by the use of a key slot 56. However, it is contemplated that other types of connection between the driving hub 44 and the driving shaft may also be used (for example, splined engagement, the use of fasteners, and so forth). The illustrated opening 54 extends entirely through the body 48 from one axial end to the other axial end, although it is contemplated that the opening 54 need not necessarily extend the full length of the driving hub 44.

Figure 6:
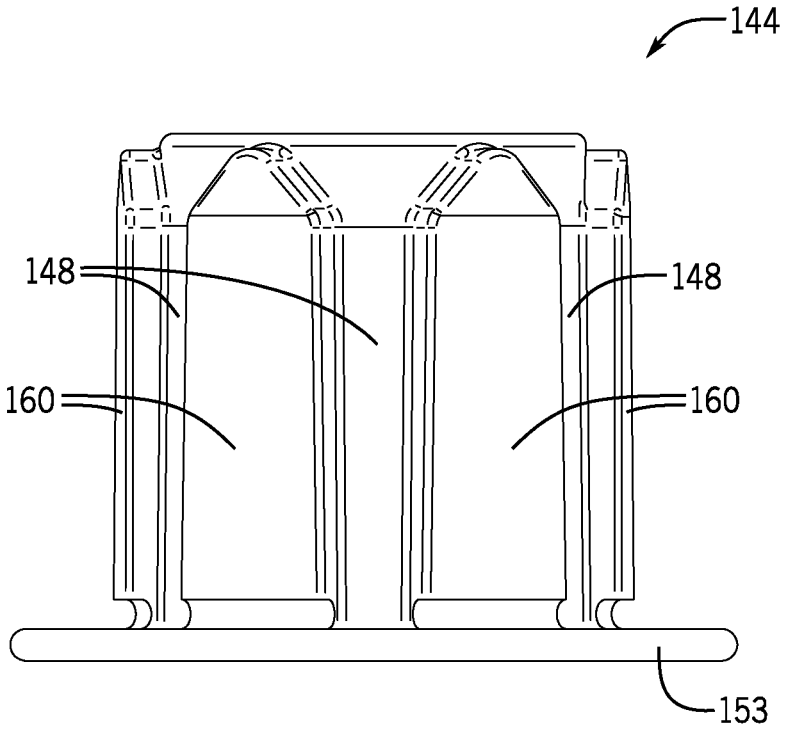
FIG. 6 PRIOR ART
FIG. 6 is a prior art driving hub design in which the splines are parallel to the axis of rotation of the hub.

Most notably, the body 44 has a radially outward facing surface 58 that supports a plurality of axially-inclined splines 60. In the form illustrated, there are eight splines which are two more than the six splines in found in the prior art type assembly of FIG. 6. These axially-inclined splines 60 are oblique or inclined with respect to the axis of rotation A-A. In the form illustrated, the angle of inclination of the splines 60 relative to the axis of rotation A-A is approximately 10 to 14 degrees. Although the splines 60 are angled with respect to the axis of rotation A-A, they do not have a steep enough angle to be considered threads in the traditional sense.

The driving hub 44 and its respective splines 60 are shaped to accommodate insertion of the cylindrical brush 46 onto the insertion end 50 of the driving hub 44 (or idler hub 25). This is done in two ways. First, a radially inward taper 62 is formed on the insertion end 50 of the driving hub 44 on the radially outward facing surface 58 along which the splines 60 extend. Second, the width of the splines 60 at their axial ends 64 narrow as they approach the insertion end 50 of the driving hub 44. Accordingly, when the driving hub 44 is received in the cylindrical brush assembly 42, the taper 62 and narrow ends 64 of the splines 60 provide some margin of error in initial placement of the insertion end 50 relative to the receiving opening in the cylindrical brush 46.

Further, at least portions of the angular faces 66 of the splines 60 can have an undercut 68. Effectively, this undercut 68 means that there is an absence of material in at least some locations along a radial line emanating from the axis of rotation A-A to the leading edge of the angular faces 66 of the splines 60.

Turning now to the cylindrical brush 46, the cylindrical brush 46 is new further described with reference being made to FIGS. 2, 3A, and 3B showing the full cylindrical brush 46 and FIGS. 5A through 5C which provide further detail of an exemplary core 70 of the cylindrical brush 46 apart from the rest of the cylindrical brush 46.

In the form illustrated, the cylindrical brush 46 includes both a core 70 (typically fabricated from polymeric material) that is centrally disposed along the axis of rotation A-A and a shell 72 surrounding the core 70 that supports a plurality of bristles 74 on a radially outward facing surface 76 thereof. These bristles 71 are packed into various packets that are arranged into a dotted spiral pattern. However, this pattern of the bristles 74 is merely exemplary and is no way limiting. Other bristle configurations are also contemplated. The shell 72 has a radially inward facing surface 78 that surrounds a radially outward facing surface 80 of the core 70 and the radially outward facing surface 80 of the core 70 and the radially inward facing surface 72 of the shell 72 may be connected or joined to one another in a number of ways such as for example, but not limited to, mechanical interference fit, adhesive, fastening components, and so forth. In any event, the core 70 and the shell 72 are joined together such that upon rotation of the core 70, the shell 72 rotates with the core 70.

One having ordinary skill in the art will appreciate that while the core 70 and the shell 72 are shown as two separate components, that they may be combined as a single part without losing the disclosed functionality. In such a single part configuration the core and shell may be simply integrated into a single part both supporting the bristles and having the splines described below.

Figure 5A:
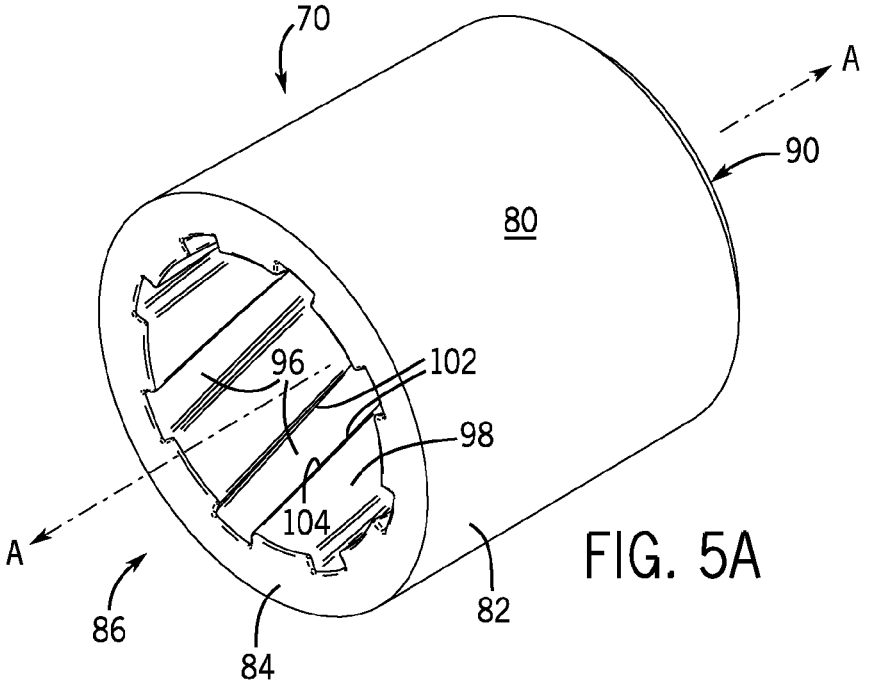
FIGS. 5A through 5C are various views of the core of the cylindrical brush assembly, apart from the shell, including a perspective view, a side view, and a cross-sectional side view, respectively.
Figure 5B:
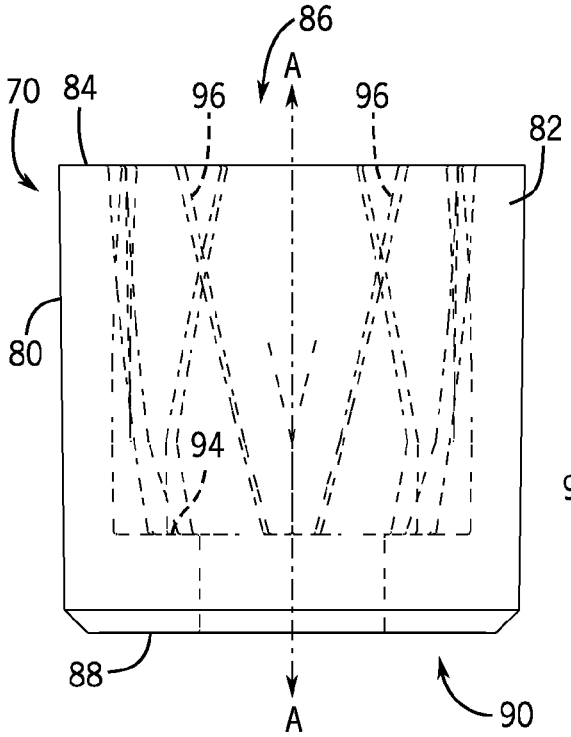
Figure 5C:
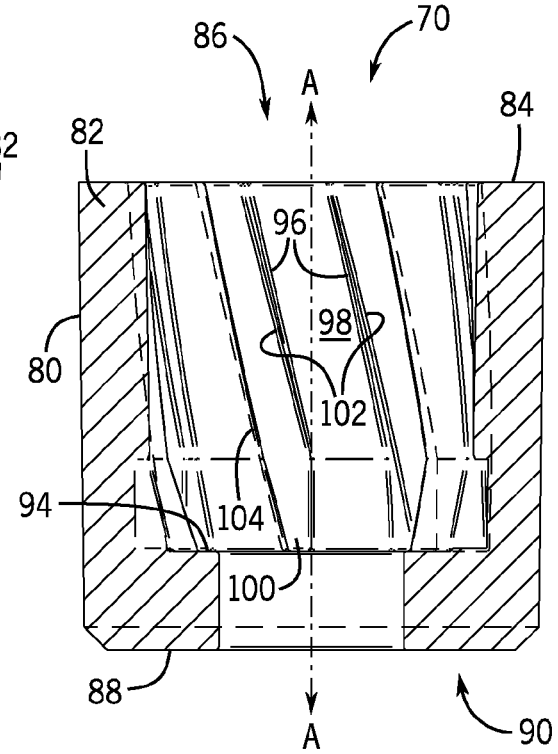

Looking more closely at the core 70 in FIGS. 5A through 5C, the core 70 is a generally cylindrically shaped body 82 extending from an axial face 84 at the insertion end 86 to an axial face 88 at a base end 90. The aforementioned radially outward facing surface 80 of the core 70 extends between these axial faces 84 and 86 and (in the two-part configuration illustrated) may be surrounded by the shell 72 as best illustrated in FIGS. 3A and 3B. The core 70 also includes an axially-extending opening 92 extending from the axial face 84 at the insertion end 86 to a stepped face 94 proximate the base end 90.

A plurality of axially-inclined splines 96 are formed on a radially inward facing surface 98 extending between the axial face 84 of the insertion end 86 and the stepped face 94 proximate the base end 90. These axially-inclined splines 98 correspond in shape to the axially-inclined splines 60 on the driving hub 44. That is to say, the splines 98 of the core 70 are the negative of the splines 60 of the driving hub 44 with some additional amount of engineered clearance to permit assembly and insertion of the parts. Again, the splines 98 are inclined approximately 10 to 14 degrees relative to the axis of rotation A-A and have narrow ends 100 near the stepped face 94 at the base end 90 to match the narrowing at the ends 64 of the splines 60 of the driving hub 44. At the base end 90, the opening 92 further extends from the stepped face 94 to the axial face 88 at the base end 90.

Again, the angular faces 102 of the splines 96 can also have an undercut 104 that mates with and generally corresponds to the undercut 68 of the driving hub 44.

Returning now to FIGS. 3A and 3B, the assembly of the cylindrical brush assembly 42 by insertion of the driving hub 44 into the core 70 of the cylindrical brush 46 is illustrated. This is effectively a detailed view of the re-assembly step on one side of the brush 46 that will occur when the exploded assembly of FIG. 1B is put back together. First, as illustrated in FIG. 3A, the insertion end 50 of the driving hub 44 is positioned next to the insertion end 86 of the core 70 such that the splines 60 and 96 align with one another. Then, the body 48 of the driving hub 44 is axially inserted into the opening 92 of the core 70, while rotationally twisting the hub 44 relative to the brush 46 (as this is guided by the axially inclined splines 60, 96 on the parts). Eventually, the insertion is completed to the point at which the flange 53 abuts the axial face 84 of the core 70 at the insertion end 86 (or the flange 53 and face 84 abut an intermediate seal or gasket 47 therebetween). This position is illustrated in FIG. 2 and in the partial breakaway view of FIG. 3B. A similar action occurs when the idler hub 25 is inserted in the opposite axial end of the brush 46.

With the cylindrical brush assembly 42 assembled, the driving hub 44 can be rotationally driven to rotate the cylindrical brush 46. From the perspective of FIGS. 2, 3A, and 3B, the driving hub 44 is driven forward in a clockwise direction relative to the page to cause the rotation of the cylindrical brush 46 about the axis of rotation A-A. As this occurs, the axially-inclined splines 60 and 96 engage one another, and the brush 46 and its core 70 are driven both rotationally and further axially towards the flange 53, capturing and compressing the gasket 47 between the flange 53 and brush 46, effectively maintaining the core 70 of the cylindrical brush 46 on the driving hub 44 and continually pulling it onto the hub 44. This prevents the side-to-side drift of the brush 46 and further helps to form a seal between the mating surfaces of the hub 44 and the brush 46 (for example, between the flange 53 and the axial face 84 of the core 70) via the intermediate gasket 47 to prevent the ingress of debris into the interface between the brush 46 and hub 44. Further, by avoiding the positional side-to-side float, the stress points applied to the splines are more consistent.

Finally, the engagement of the undercuts 68 and 104 with one another help to grip the splines 60 and 96 together, centering the hub 44 and brush 46 with respect to one another about an axis of rotation A-A. Further, these undercuts 68 and 104 help to maintain the engagement of the splines 60 and 96.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A cylindrical brush for use in a cylindrical brush assembly of a floor maintenance machine, the cylindrical brush comprising:

a core extending along an axis of rotation and having an opening centrally disposed along the axis of rotation with a radially inward facing surface supporting a plurality of axially-inclined splines wherein each of the plurality of axially-inclined splines have a respective centerline between a respective pair of angular faces of each respective spline in which the respective centerline is angularly inclined relative to the axis of rotation as the respective centerline extends around the core in a circumferential direction; and a plurality of radially extending bristles supported by the core.

2. The cylindrical brush of claim 1, further comprising a shell surrounding a radially outward facing surface of the core, wherein the plurality of radially extending bristles are supported by the shell.

3. The cylindrical brush of claim 1, further comprising an undercut on one of the respective pair of angular faces of at least some of the plurality of splines on the core.

4. The cylindrical brush of claim 1, wherein the plurality of axially-inclined splines extend less than 90 degrees angularly around the axis of rotation from one axial end of the opening of the core to an other axial end of the opening of the core.

5. The cylindrical brush of claim 1, wherein an angle of inclination between the axis of rotation and the plurality of axially-inclined splines is between four and six degrees.

6. The cylindrical brush of claim 1, wherein the respective pairs of angular faces are parallel with one another and axially-inclined for at least some axial distance of the core as the respective pairs of angular faces extend circumferentially around the axis of rotation.

7. A cylindrical brush assembly for a floor maintenance machine, the cylindrical brush assembly comprising:

a driving hub having a radially outward facing surface with a plurality of axially-inclined splines that are oblique to an axis of rotation of the driving hub; and a cylindrical brush having a core having a radially inward facing surface with a plurality of axially-inclined splines corresponding to the plurality of axially-inclined splines on the driving hub wherein each of the plurality of axially-inclined splines on the cylindrical brush have a respective centerline between a respective pair of angular faces of each respective spline in which the respective centerline is angularly inclined relative to the axis of rotation as the respective centerline extends around the core in a circumferential direction, the cylindrical brush being received on one axial end of the driving hub such that the plurality of axially-inclined splines of the driving hub engage the plurality of axially-inclined splines of the core of the cylindrical brush.

8. The cylindrical brush assembly of claim 7, wherein the driving hub has an insertion end on one axial end of the driving hub that is received into the core of the cylindrical brush and a flanged end on the other axial end of the driving hub.

9. The cylindrical brush assembly of claim 8, wherein, when the driving hub is rotated about the axis of rotation in one of the two possible rotation directions, engagement of the plurality of axially-inclined splines of the driving hub with the plurality of axially-inclined splines of the core of the cylindrical brush cause the cylindrical brush to be both rotationally driven about the axis of rotation and axially driven toward the flanged end of the driving hub.

10. The cylindrical brush assembly of claim 8, wherein, the plurality of axially-inclined splines on the driving hub narrow at the insertion end.

11. The cylindrical brush assembly of claim 8, further comprising an opening extending through the driving hub for receiving a driving shaft.

12. The cylindrical brush assembly of claim 11, wherein the opening is keyed to facilitate a transfer of power from the driving shaft to the driving hub.

13. The cylindrical brush assembly of claim 7, wherein the cylindrical brush assembly further comprises an idler hub received on the other axial end of the core of the cylindrical brush, the idler hub sharing the axis of rotation of the cylindrical brush and the driving hub, and the idler hub having a radially outward facing surface with a plurality of axially-inclined splines that are oblique to the axis of rotation.

14. The cylindrical brush assembly of claim 7, wherein the cylindrical brush further comprises a shell surrounding the core and on this shell a plurality of radially extending bristles are supported.

15. The cylindrical brush assembly of claim 7, further comprising an undercut on the angular faces of at least some of the plurality of splines on one of the core and driving hub in which the undercut engages a mating undercut on the angular faces of at least some of the plurality of splines on the other one of the core and driving hub.

16. The cylindrical brush assembly of claim 7, wherein the plurality of axially-inclined splines on the driving hub and the cylindrical brush extend less than 90 degrees angularly around the axis of rotation from one axial end of the splines to the other.

17. The cylindrical brush assembly of claim 7, wherein an angle of inclination between the axis of rotation and the plurality of axially-inclined splines is between four and six degrees.

18. The cylindrical brush assembly of claim 7, wherein the respective pairs of angular faces are parallel with one another and axially-inclined for at least some axial distance of the core as the respective pairs of angular faces extend circumferentially around the axis of rotation.

19. A floor maintenance machine comprising the cylindrical brush assembly of claim 7.

20. A core for use in a cylindrical brush, core comprising:

a body extending along an axis of rotation and having an opening centrally disposed along the axis of rotation with a radially inward facing surface supporting a plurality of axially-inclined splines wherein each of the plurality of axially-inclined splines have a respective centerline between a respective pair of angular sides of each respective spline in which the respective centerline is angularly inclined relative to the axis of rotation as the respective centerline extends around the body in a circumferential direction.

21. The core of claim 20, wherein the plurality of axially-inclined splines extend less than 90 degrees angularly around the axis of rotation from one axial end of the opening of the core to the other axial end of the opening of the core.

22. The core of claim 20, wherein an angle of inclination between the axis of rotation and the plurality of axially-inclined splines is between four and six degrees.

23. The core of claim 20, wherein the respective pairs of angular faces are parallel with one another and axially-inclined for at least some axial distance of the body as the respective pairs of angular faces extend circumferentially around the axis of rotation.

* * * * *